US006690255B2

(12) United States Patent
Caramela et al.

(10) Patent No.: US 6,690,255 B2
(45) Date of Patent: Feb. 10, 2004

(54) ELECTRONIC COMPONENT

(75) Inventors: Christopher Leonard Caramela, Crystal Lake, IL (US); Catalin Constantin Girbaci, Cary, IL (US); Gregory Proehl, Village of Lakewood, IL (US)

(73) Assignee: Coilcraft, Incorporated, Cary, IL (US)

( * ) Notice: Subject to any disclaimer, the term of this patent is extended or adjusted under 35 U.S.C. 154(b) by 0 days.

(21) Appl. No.: 10/080,221

(22) Filed: Feb. 21, 2002

(65) Prior Publication Data

US 2003/0156002 A1 Aug. 21, 2003

(51) Int. Cl.[7] ..... H01F 5/00

(52) U.S. Cl. ..... 336/200; 336/212; 336/192; 336/83

(58) Field of Search ..... 336/212, 200, 336/223, 232, 83, 192

(56) References Cited

U.S. PATENT DOCUMENTS

| | | | | |
|---|---|---|---|---|
| 3,199,178 | A | | 8/1965 | Renskers |
| 3,332,048 | A | | 7/1967 | Renskers |
| 3,368,176 | A | | 2/1968 | Renskers |
| 3,390,364 | A | | 6/1968 | Russell |
| 3,466,381 | A | | 9/1969 | Boehmke |
| 3,534,309 | A | | 10/1970 | Renskers et al. |
| 3,666,090 | A | | 5/1972 | Johnson et al. |
| 3,671,905 | A | | 6/1972 | Renskers |
| 3,676,813 | A | | 7/1972 | Renskers |
| 3,721,747 | A | | 3/1973 | Renskers |
| 3,735,214 | A | | 5/1973 | Renskers et al. |
| 3,743,990 | A | | 7/1973 | Renskers et al. |
| 3,750,069 | A | | 7/1973 | Renskers |
| 3,812,443 | A | | 5/1974 | Schroeder |
| 3,824,514 | A | | 7/1974 | Hojnacki |
| 3,843,908 | A | | 10/1974 | Priegnitz |
| 4,024,438 | A | | 5/1977 | Priegnitz |
| 4,209,826 | A | | 6/1980 | Priegnitz |
| 4,530,563 | A | | 7/1985 | Brzezinski |
| 4,926,151 | A | | 5/1990 | Morinaga |
| 5,307,041 | A | | 4/1994 | Kato et al. |
| 5,541,567 | A | | 7/1996 | Fogel et al. |
| 5,760,669 | A | | 6/1998 | Dangler et al. |
| 5,760,670 | A | * | 6/1998 | Yeh et al. ..... 336/134 |
| 5,796,324 | A | | 8/1998 | Ross et al. |
| 6,285,272 | B1 | | 9/2001 | Boytor et al. |
| 6,294,975 | B1 | * | 9/2001 | Chen ..... 336/198 |
| 6,414,583 | B1 | * | 7/2002 | Yeh et al. ..... 336/200 |
| 6,472,969 | B1 | * | 10/2002 | Hanato ..... 336/192 |
| 6,522,230 | B2 | * | 2/2003 | Hanato et al. ..... 336/83 |
| 6,535,095 | B2 | * | 3/2003 | Aoki et al. ..... 336/83 |

FOREIGN PATENT DOCUMENTS

| | | |
|---|---|---|
| JP | 58-184815 | 12/1983 |
| JP | 7-074028 | 3/1995 |
| JP | 7-288210 | 10/1995 |
| JP | 10323670 | 12/1998 |
| JP | 11-54345 | 2/1999 |
| KR | 2001-0045690 | 6/2001 |
| WO | WO 92/05568 | 4/1992 |
| WO | WO 02/089156 | 11/2002 |

* cited by examiner

*Primary Examiner*—Anh Mai
(74) *Attorney, Agent, or Firm*—Fitch, Even, Tabin & Flannery

(57) ABSTRACT

A low profile surface mountable component having a strengthened structure in accordance with the disclosure set forth herein comprises an elongated core having first and second ends and first and second supports for supporting the core and for absorbing forces experienced by the component that are attributable to mechanical shock. Each of the supports defines a receptacle for receiving one of the core's first and second ends. The component further comprises means between the ends of the core and the supports for permitting movement of the core with respect to the supports, and has metalized pads provided on the supports for electrically connecting and mounting the support to the printed circuit board. At least one wire is wound about a portion of the core and has its ends electrically connected to the metalized pads of the supports.

19 Claims, 7 Drawing Sheets

ELECTRONIC COMPONENT

BACKGROUND OF THE INVENTION

This invention relates generally to electronic components and more particularly concerns low profile surface mountable electronic components having strengthened structures for absorbing forces attributable to mechanical shock.

The electronics industry is continually called upon to make products smaller and more powerful. Applications such as mobile phones, portable computers, computer accessories, hand-held electronics, etc., create a large demand for smaller electronic components. These applications further drive technology to research new areas and ideas with respect to miniaturizing electronics. Often times, applications specifically require "low profile" components due to constraints in height and width. Unfortunately, the technology is often limited due to the inability to make certain components smaller, faster, or more powerful. Nowhere can this be seen more than in the struggle to manufacture smaller electronic circuits.

Originally, components were mounted on a printed circuit board (PCB) by inserting the leads of the component through the PCB and soldering them to solder pads on the opposite side of the PCB, (called through-hole technology). This technique left half of the PCB unpopulated because one side had to be reserved for solder pads and solder. Therefore, in order to fit more components in a particular circuit, the PCBs were made larger, or additional PCBs were required. Many times, however, these options were not available due to constraints in size for the PCBs The solution to this problem came in the form of Surface-Mount Devices (SMD), or Surface-Mount Technology. SMDs allow electrical components to be mounted on one side of a PCB, (i.e., without having the leads inserted through-holes). An SMD device has small metalized pads (solder pads or leads) connected to its body, which correspond to solder pads or lands placed on the surface of the PCB. Typically the PCB is run through a solder-paste machine (or screen printer), which puts a small amount of solder on the solder pads on the PCB. Next, a glue dot is inserted on the PCB where the component is to rest. Then, the component is placed on the PCB (held by the glue dot), and the PCB is sent through a re-flow oven to heat the solder paste and solder the component leads to the PCB solder pads. The primary advantage to this technique is that both sides of the PCB can now be populated by electronic components. Meaning one PCB today can hold an amount of electrical components equal to two PCBs in the past.

As a result of this advancement in technology, the current electronic circuits are mainly limited by the size of components used on the PCB. Meaning, if the electronic components are made smaller, the circuits are smaller as well. Unfortunately, there are some electronic components that can simply not be produced any smaller than they currently are. Usually this is because the desired parameters for the component cannot be achieved when using smaller parts and/or because the desired mechanical strength of the component cannot be met. A good example of this is inductive components. Inductive components are often used in stepper motors, transformers, servos, relays, inductors, antennas, etc. Typical applications requiring such components include radio frequency (RF), switching power supplies, converters, data communications, processor/controller circuits, signal conditioning circuits, biasing oscillators, DC-DC converters, DC-AC converters, chokes, IC investors, filters, etc. Certain parameters of these components are affected by the size of parts used. For instance, in inductors, wire gauge determines both the DC resistance and the current carrying ability of the component.

Furthermore, some electronic components cannot be manufactured in smaller forms because the smaller components simply cannot withstand the mechanical stresses and forces that such components are exposed to during testing or use. For example, certain materials used to manufacture smaller electronic components are often more brittle than other materials and are thus less able to withstand the mechanical forces exerted on the component during drop tests or normal use of the component. One example of this involves the materials used to manufacture the low profile antennas used in key fobs (or transmitters of keyless entry systems), which are often so brittle that they cannot withstand standard drop tests or certain drops which occur during typical usage of the device.

Moreover, some materials used to manufacture smaller electronics have temperature coefficient mismatches with the other portions of the component and/or the PCB which prevent them from being used in certain applications. For example, if some of the materials used to manufacture the transformers used for liquid crystal display (LCD) backlighting do not have closely matching temperature coefficients, one material may expand/contract during temperature changes faster or more than another material causing the connection between these materials to break. Such conditions cause component failures when the component is tested at temperature or used in elevated temperature conditions.

Accordingly, it has been determined that the need exists for an improved low profile electronic component which overcomes the aforementioned limitations and which further provides capabilities, features and functions, not available in current devices.

SUMMARY OF THE INVENTION

A low profile electronic component in accordance with the invention comprises a core having first and second ends with a main horizontal section extending therebetween and first and second supports for supporting the core and for absorbing forces applied to the component that are attributable to mechanical shock (e.g., impact forces, thermal stresses, etc.). Each support defines a receptacle for receiving one of the core's first and second ends and provides a metalized pad with which the component can be electrically connected and mounted to a printed circuit board (PCB). Wire is wound about at least a portion of the main horizontal section of the core and the ends of the wire are connected to the metalized pads of the supports. The combination of supports and core allow the electronic component to withstand greater forces than if the component was made by simply using one solid portion.

In one embodiment, the electronic component comprises an antenna having a wire wound about a majority of the main horizontal section of the core. One end of the wire is electrically connected to a metalized pad located on one of the supports and the other end of the wire is electrically connected to a metalized pad located on the other support. A top portion may also be provided with the component so that it can be picked up using industry standard component placement equipment. This top portion can comprise a simple flattened rectangular surface connecting the supports or, as in the embodiment shown in the attached drawing figures, can comprise a generally flat top surface with outer sidewalls extending downward therefrom for covering at least a portion of the wire wound core.

In another embodiment, the electronic component comprises a transformer wherein the core comprises a sleeve within which an insert is disposed. The sleeve has first and second ends with a main horizontal section extending therebetween and at least one raised portion located about the main horizontal section of the sleeve for separating the sleeve into a first portion and a second portion. In the preferred form of this embodiment, the first and second ends of the sleeve are capable of being inserted into the receptacles of the supports and each support has at least two metalized pads. A first wire is wound around the first portion of the sleeve and has the ends of the wire connected to the metalized pads of one support (e.g., one end connected to one of the metalized pads of the first support and a second end connected to another one of the metalized pads on the first support). A second wire is then wound around the second portion of the sleeve and has the ends of the wire connected to the metalized pads of the other support.

A top portion may also be provided with the transformer component so that it can be picked up using industry standard component placement equipment. This top portion can comprise a generally flat top surface made from an acrylic or, as in a preferred embodiment, may comprise a magnetic material such as ferrite in order to enhance the performance of the electronic component. In alternate forms, the top portion may further comprise a generally flat top surface with outer sidewalls extending downward therefrom for covering at least a portion of the wire wound core, as discussed above.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENTS

Figure 1:
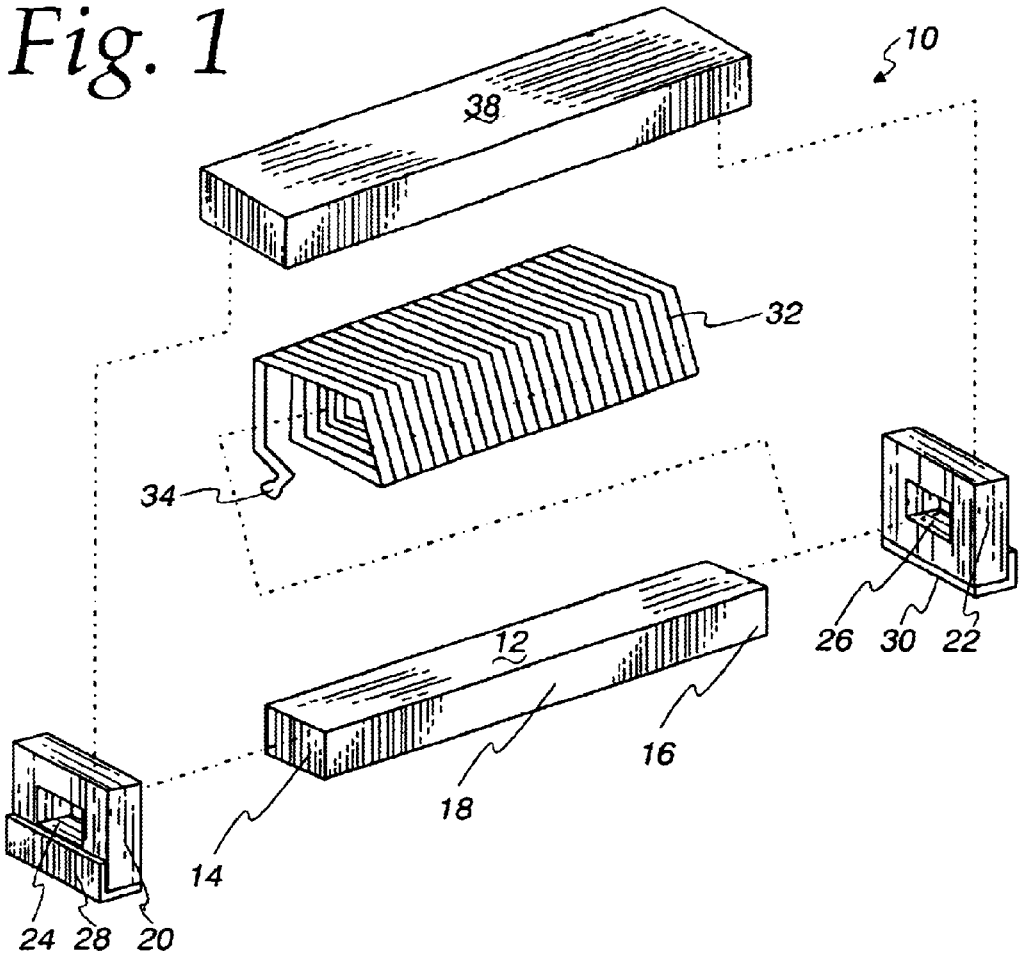
FIG. 1 is an exploded view of a low profile electronic component according to the invention.

A low profile electronic component in accordance with the invention comprises a core having first and second ends with a main horizontal section extending therebetween and first and second supports for supporting the core and for absorbing forces applied to the component that are attributable to mechanical shock (e.g., impact forces, thermal stresses, etc.). Each support defines a receptacle for receiving one of the core's first and second ends and provides a metalized pad with which the component can be electrically connected to a printed circuit board (PCB). Wire is wound about at least a portion of the main horizontal section of the core and the ends of the wire are connected to the metalized pads of the supports. The combination of the supports and core allow the electronic component to withstand greater forces than if the component was made by simply using one solid portion. This, however, does not mean that the supports and core must be made out of different types of material. Rather, the supports and the core can be made out of either the same material or different materials.

For example, the core may be made of a magnetic material such as ferrite and the supports may be made from a ceramic. Such a configuration allows the component to take advantage of the good magnetic properties of ferrite and the good mechanical strength of ceramic. In another example, both the core and the supports may be made of a magnetic material such as ferrite. Given the poor mechanical strength of ferrite, however, the former configuration which uses a different material for the supports is more likely to be used in most applications. In yet another example, the core may comprise a combination of materials such as a sleeve with an insert. Given the ability to select materials with different temperature coefficients, such a core could be specialized to more closely match temperature coefficients of other parts of the component or other parts surrounding the component to ensure that the component is capable of withstanding various temperature induced stresses.

The actual three part configuration of the electronic component, (e.g., the core and supports), may be used to absorb mechanical forces by allowing the core to move with respect to the supports. For example, the receptacles of the support may be structured such that the core is not press fit into the receptacle and/or such that a gap exists between at least one side of the core and the inner wall of the receptacle. With such a configuration, the core can move or flex with respect to the support. Although this movement is likely not perceptible to the human eye, the components configuration allows enough movement, such as flexing, to increase the mechanical strength of the overall component.

To further assist the component in withstanding forces related to mechanical shock, such as those generated by dropping the component or those experienced due to temperature induced strain, the core and the supports may be bonded using a semi-rigid adhesive, such as a thermal set epoxy. The semi-rigid adhesive provides additional strength to the component by allowing the supports and the core to flex without causing either to break and/or without causing the bond between the core and the supports to break. For example, the semi-rigidness of the adhesive allows for the core to flex with respect to the supports thereby absorbing some of the force experienced by the component.

Figure 2:
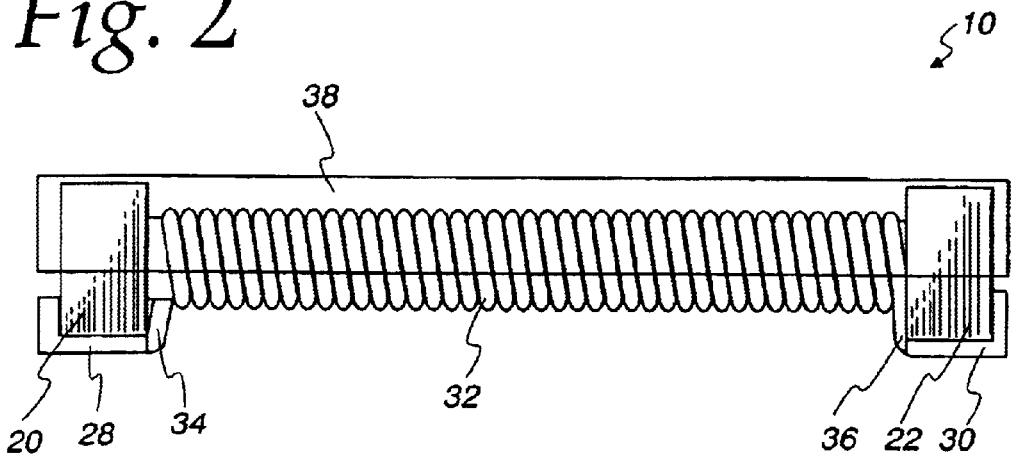
FIG. 2 is a side elevational view of the electronic component from FIG. 1 with a transparent top portion shown so that the portions of the component located within the top portion are visible.
Figure 3:
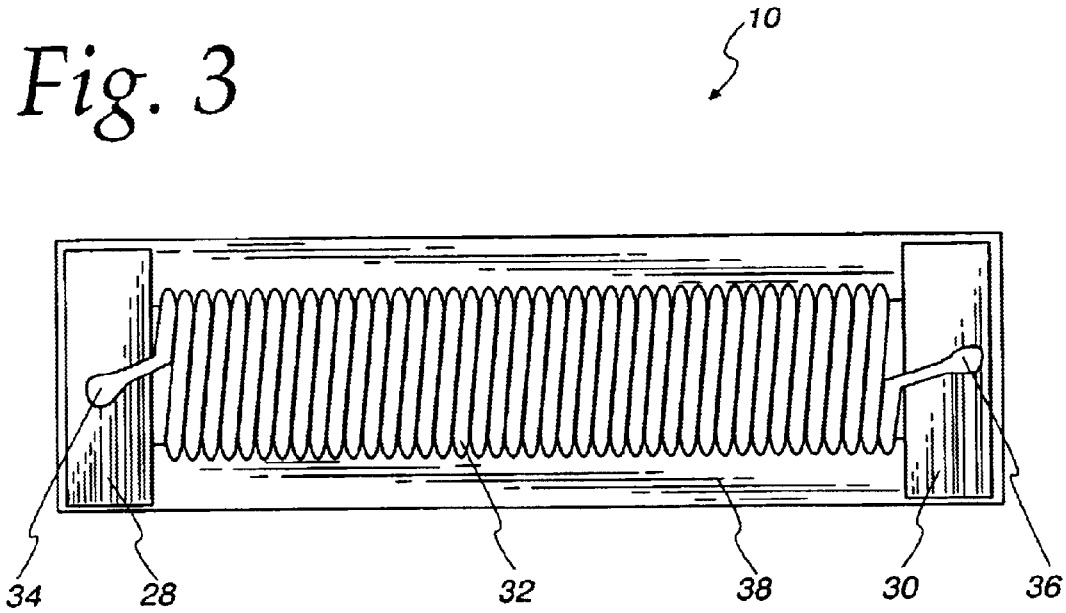
FIG. 3 is a bottom plan view of the electronic component from FIG. 1.

Turning first to FIGS. 1–3, a low profile electronic component in accordance with the invention is shown generally at reference numeral 10. In this embodiment the component 10 comprises an antenna or transponder coil having a generally rectangular shaped core 12 having first and second ends 14 and 16 with a main horizontal section 18 extending therebetween. First and second supports 20 and 22 are connected to the core 12 via respective receptacles 24 and 26. The receptacles 24 and 26 are similar in shape to that of the core 12, which may assist in positioning the supports 20 and 22 on the core 12 or further assist in squaring the supports 20 and 22 on the core 12. For example, in the embodiment shown, the rectangular shape of the core 12 and the receptacles 24 and 26 not only assists the supports in being positioned on the core but also ensures that the supports are positioned squarely on the core 12. Thus, the actual shape of the core 12 and/or receptacles 24 and 26 may serve to help orientate the supports 20 and 22 on the core 12.

Furthermore, in the embodiment shown, the rectangular shape of the core 12 assists in maintaining the low profile of the component 10. For example, a round core of same or similar volume to the rectangular core shown would add height to the component, thereby making it less desirable in applications with strict height limitations.

The receptacles 24 and 26 may also provide for at least a minimal amount of movement or flexing of the core 12 with respect to the supports 20 and 22. For example, in a preferred embodiment a gap exists between the core 12 and the receptacles 24 and 26 to provide for minor movements of the core 12 with respect to the supports 20 and 22. The ability to make such movements increases the overall component's strength by allowing it to absorb forces applied thereto, (e.g., the component can flex when under pressure without breaking). The presence of a gap also allows for variances in the tolerances of the core and the supports, thereby reducing the expense of such items by eliminating the need for each item to be produced to an exact specification.

The supports 20 and 22 also have metalized pads 28 and 30 which are used to electrically connect the components to corresponding lands on a PCB. In this way, the component can be added into a circuit located on a PCB. The metalized pads 28 and 30 are preferably L-shaped in order to strengthen the coupling between the metalized pad and the support and in order to strengthen the solder connection created between the component and the lands on the PCB. Similar benefits are achieved by making the metalized pads 28 and 30 cover the entire bottom surface of the supports 20 and 22. Although the L-shape and coverage of the entire bottom surface of the support are not essential for the component to be electrically connected to the PCB, such features also add to the mechanical strength of the component.

The electronic component 10 also includes a wire 32 wound about at least a portion of the main horizontal section 18 of the core 12. In the embodiment shown, the wire 32 is made from an electrically conductive material such as copper and has first and second ends 34 and 36 which are electrically connected to the metalized pads 28 and 30 so that the component can be electrically connected to a circuit on the PCB when soldered thereto. More particularly, the first end 34 is connected to metalized pad 28 and the second end 36 is connected to metalized pad 30. Both ends 34 and 36 are flattened or pressed so as to minimize the amount each sticks out from the bottom of the metalized pads 28 and 30. This minimizes the amount metalized pads 28 and 30 will be raised from the corresponding lands on the PCB and helps ensure that both the wire ends 34 and 36 and the pads 28 and 30 will be coated with solder when the component is soldered to the PCB. Further, the flattened ends 34 and 36 allow the component 10 to rest more squarely on the PCB making placement of the component easier. Using the receptacle and/or core shape to orientate the supports 20 and 22 on the core 12 can also assist in ensuring that the metalized pads of the supports are in the same general plane so that the component will rest properly on the PCB.

The electronic component 10 may also have a top portion 38 connected to the component for providing a flattened surface with which the component can be picked up using industry standard component placement equipment, such as pick-and-place machines. Such a top portion 38 allows the component 10 to be packaged in tape and reel packaging which is widely used and preferred by purchasers of electronic components. In the embodiment shown, the top portion 38 is connected to the upper surfaces of the supports 20 and 22, and is generally rectangular in shape with outer side walls **38*b* extending downward therefrom. Such a configuration allows the top portion 38 to operate as a cover over the top of the supports 20 and 22 and at least a portion of the wire wound core 12. This also provides the added protection of covering the current carrying wire 32** so that it cannot be inadvertently touched while carrying current.

In a preferred form, the top portion 38 is made of an acrylic and is used to provide a generally flat top surface for vacuum pick-and-place equipment to remove and place the packaged component 10. In alternate forms, however, the top portion 10 may be made of a magnetic material such as ferrite to further enhance the performance of the component 10. This type of configuration will be discussed further below with respect to another embodiment of the invention. Such a component can be used in applications such as Radio Frequency Identification Devices (RFID), transponders, keyless entry systems, antennas, tire gages, etc. Moreover, the actual materials used for the various parts of the compenent, (e.g., the core 12, supports 20 and 22), may be selected specifically for the particular application for which the component will be used. For example, in applications requiring a more sensitive coil 32, a core material having a higher permeability will be used. The higher the permeability of the material is, the higher the inductance of the component will be and the more sensitive the coil will be, albeit operating at a lower frequency. Alternatively, if the application calls for the component to operate at a higher frequency or with a less sensitive coil, materials with lower permeability values may be selected.

Figure 4A:
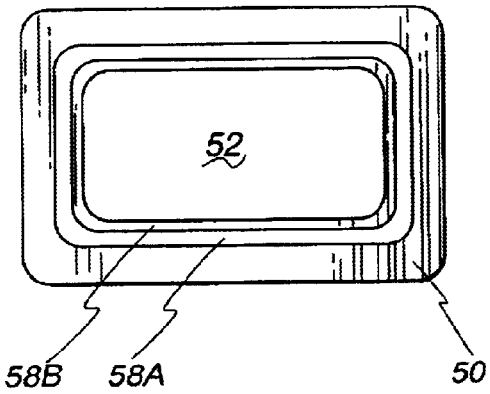
FIG. 4A is a front elevational view of a support to be used with the component from FIG. 1.
Figure 4B:
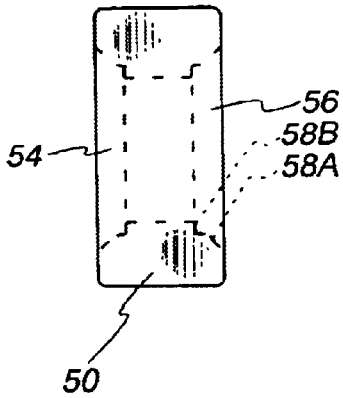
FIG. 4B is a side elevational view of the support from FIG. 4A showing portions of the receptacle in phantom.

FIGS. 4A–B show one form of support that can be used with component 10. For purposes of clarity this support will be referred to generally by reference numeral 50. Like the supports discussed above, the support 50 is generally rectangular in shape and defines a generally rectangular receptacle 52. One notable difference, however, is that the openings 54 and 56 of the receptacle 52 are beveled or tapered via shoulders 58*a* and 58*b*. This configuration provides a lead-in which assists in inserting the core 12 into the support 50. The surface of shoulder 58*a* is preferably angled at forty-five degrees and, together with shoulder 58*b*, assists in wicking semi-rigid adhesive between the inner surfaces of the receptacle 52 and the outer surfaces of the first and second ends of the core 14 and 16.

In the embodiment shown in FIGS. 4A–B, the receptacle 52 is a through opening that passes through the entire support 50. The openings 54 and 56 are beveled on each side of the support 50 so that the part can be used on either side of the core 12, (e.g., so that an end of the core can be inserted into either opening 54 or 56 of the support). This makes the support 50 a universal part that can be used on either end of the core 12 and reduces the orientation requirements for the part. Such a configuration saves costs by requiring less tooling and reduces manufacturing time by eliminating the need to determine which end of the core the support goes on.

The receptacle 52 is generally equal in height to the core 12, in order to create a frictional fit between these items of the component; however, in a preferred embodiment the width of the receptacle 52 is slightly larger than the width of the core 12 so that a gap may be created between the core 12 and the support 50. For example, in the embodiment shown, the core is approximately 1.02 mm high, 2 mm wide, and 11 mm long. Whereas the through opening of the receptacle 52 is approximately 1.09 mm high by 2.16 mm wide. As discussed above, this gap between the core 12 and the support 50 allows for the core to move or flex with respect to the support 50 thereby strengthening the component's ability to absorb and/or withstand mechanical forces experienced by the component 10.

Figure 5A:
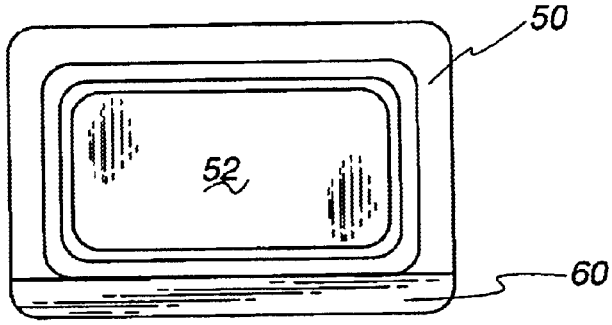
FIG. 5A is a front elevational view of the support from FIGS. 4A–B showing a metalized pad which can be used with the support.
Figure 5B:
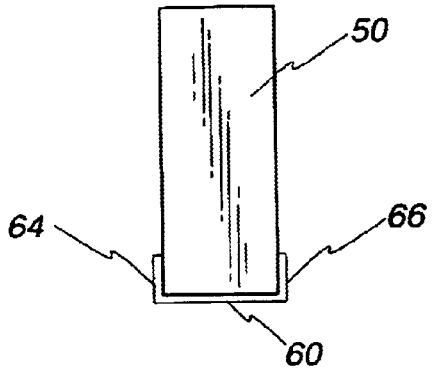
FIG. 5B is a side elevational view of the support and metalized pad from FIG. 5A.
Figure 5C:
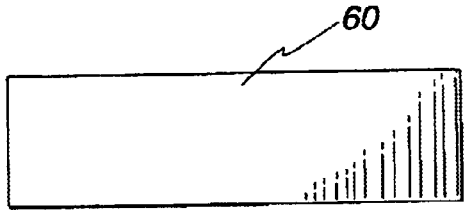
FIG. 5C is a bottom plan view of the metalized pad from FIGS. 5A–B.

FIGS. 5A–C show how an alternate metalized pad 60 which may be used with the supports of component 10. This pad 60 is particularly useful with respect to universal parts such as support 50 due to its symmetrical configuration. The pad 60 is generally U-shaped, having a flat bottom surface 62 with sidewalls 64 and 66 extending therefrom. Such a configuration not only makes the part more universal due to its symmetry, but also strengthens the connection between the metalized pad 60 and the support 50, and the connection between the component and the corresponding lands located on the PCB once the component is soldered thereto. For example, the additional sidewall 64 or 66 increases the amount of surface area connecting the metalized pad 60 to the support 50 thereby increasing the strength between the pad 60 and the support 50. Similarly, the metalized pad 60 contains more surface area which can be soldered to the corresponding lands on the PCB, thereby increasing the mechanical strength of the connection between these two items.

Although the creation of universal parts for an electronic component are beneficial for obvious reasons with respect to the components manufacture, such parts are not essential. For example, the supports used with the component 10 may be configured with receptacles that require the core 12 to be inserted in a specific or predetermined way. While not as efficient, such components would still provide the support and mechanical strengthening functions for the component. An example of how this might be achieved is discussed further below.

Figure 6:
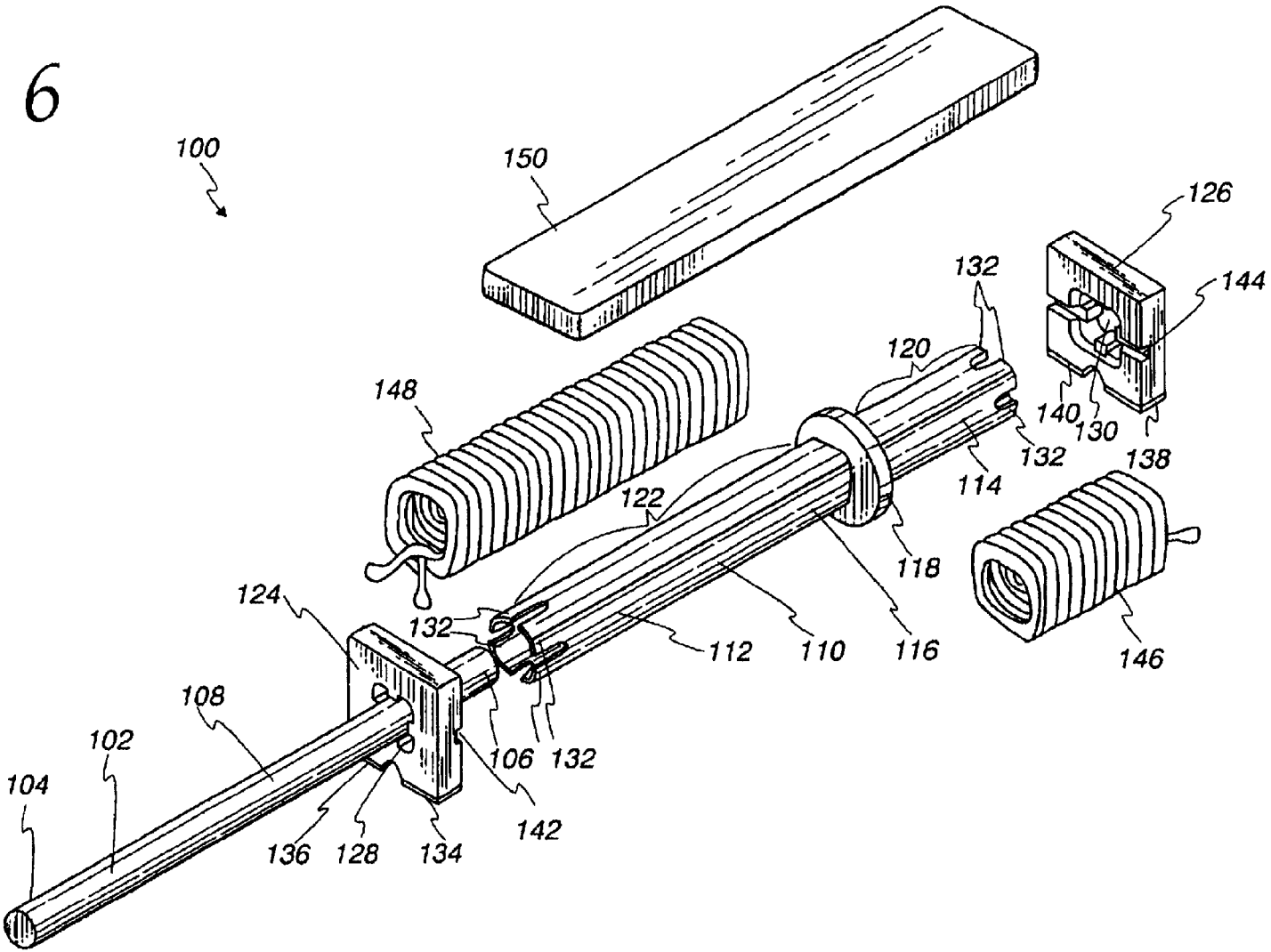
FIG. 6 is an exploded view of an alternate embodiment of a low profile electronic component according to the invention.
Figure 7:
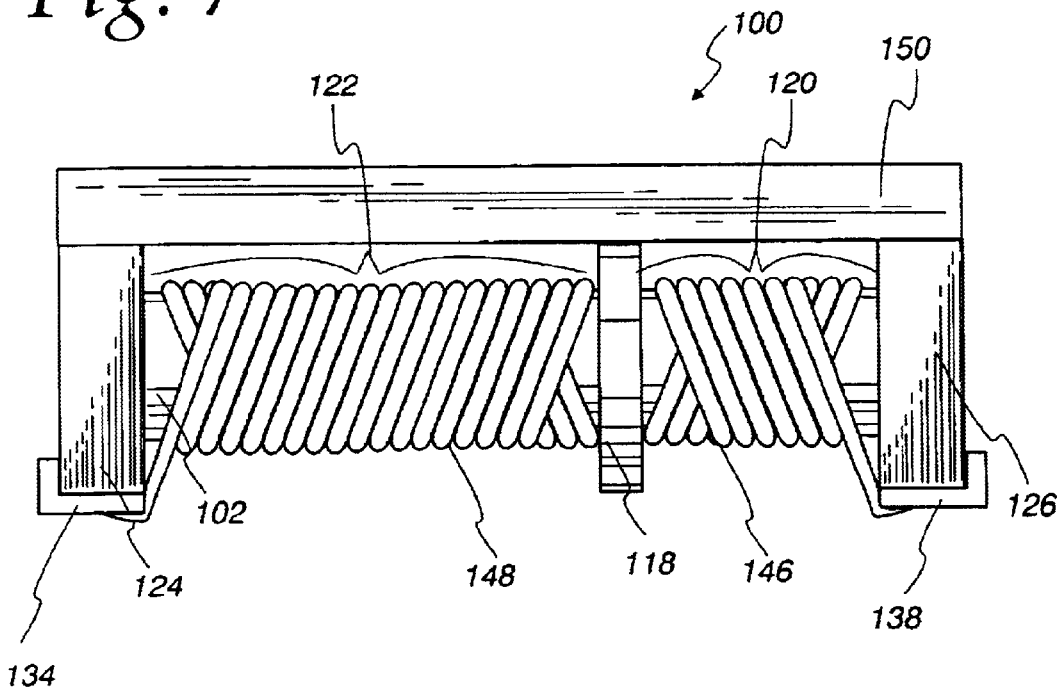
FIG. 7 is a side elevational view of the electronic component from FIG. 6.
Figure 8:
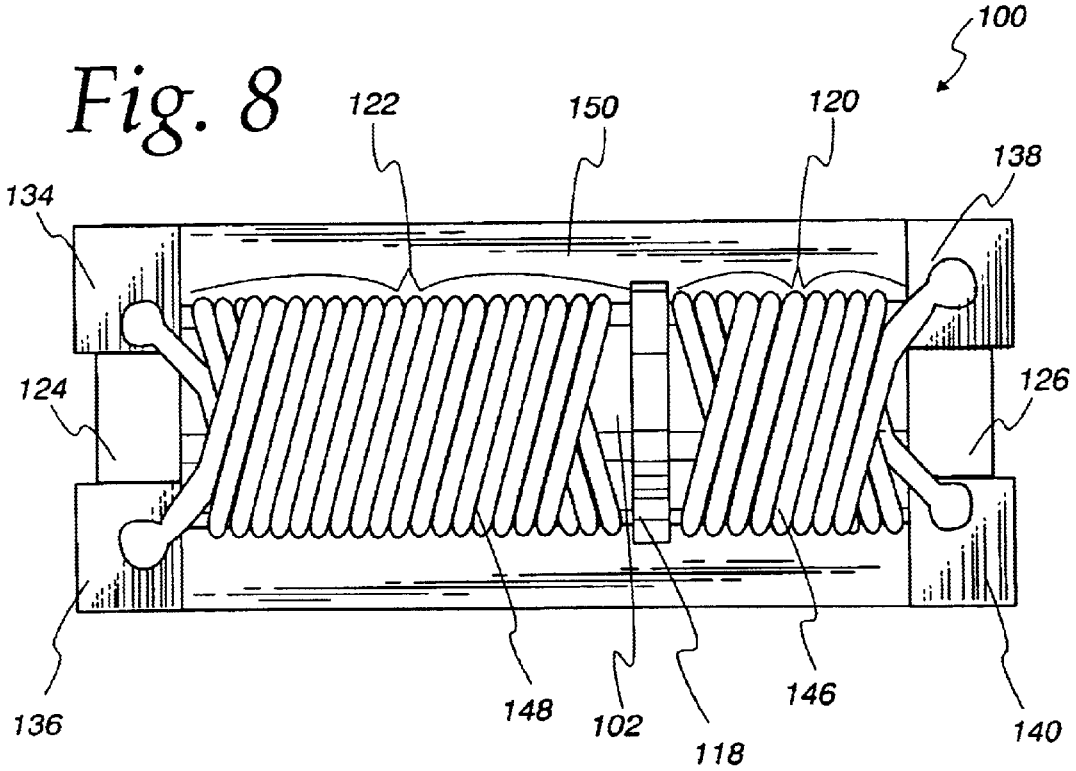
FIG. 8 is a bottom plan view of the electronic component from FIG. 6.
Figure 9A:
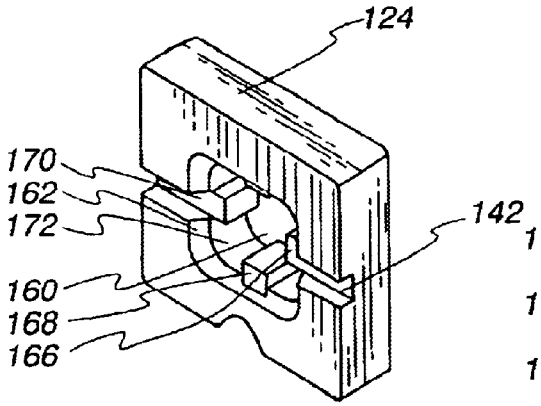
FIG. 9A is a perspective view of one of the supports from FIG. 6.
Figure 9B:
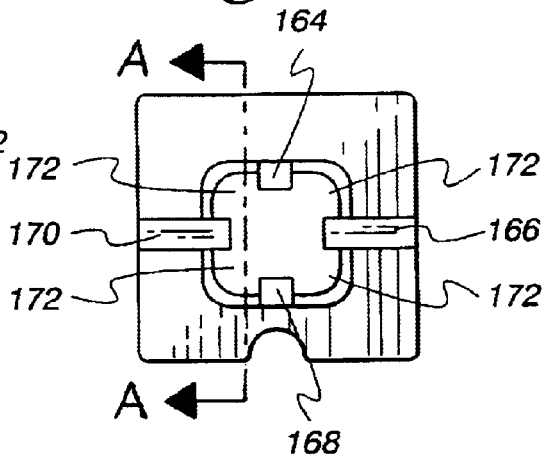
FIG. 9B is a front elevational view of the support from FIG. 9A.
Figure 9C:
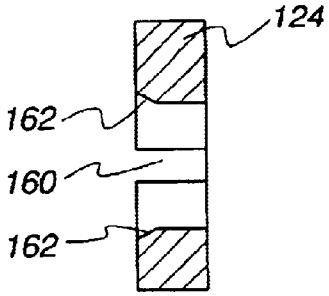
FIG. 9C is a cross-sectional view of the support from FIGS. 9A–B with the cross-section taken along lines A—A in FIG. 9B.
Figure 9D:
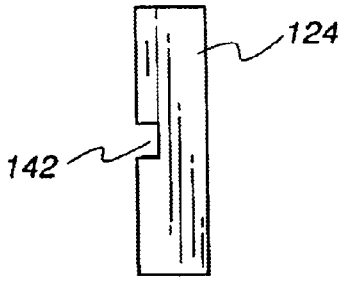
FIG. 9D is a side elevational view of the support from FIGS. 9A–C.
Figure 9E:
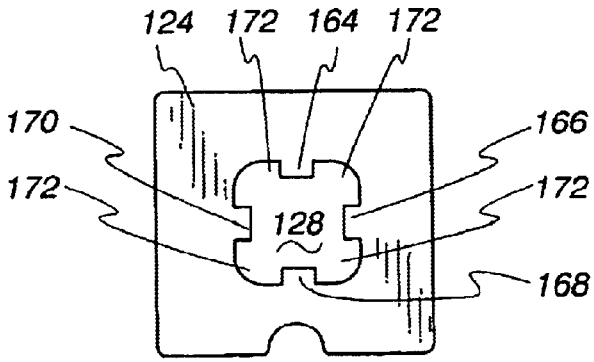
FIG. 9E is a rear elevational view of the support from FIGS. 9A–D.
Figure 10A:
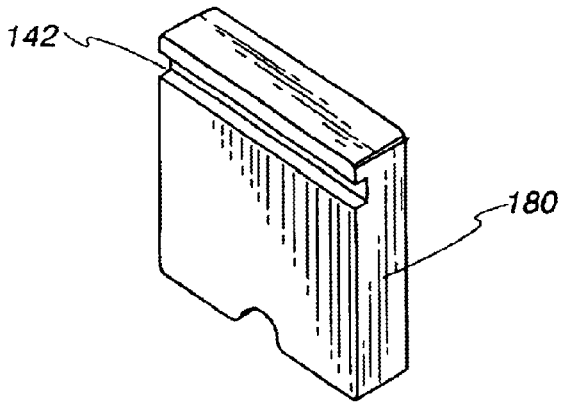
FIG. 10A is a perspective view of an alternate supports which can be used with the electronic component from FIG. 6.
Figure 10B:
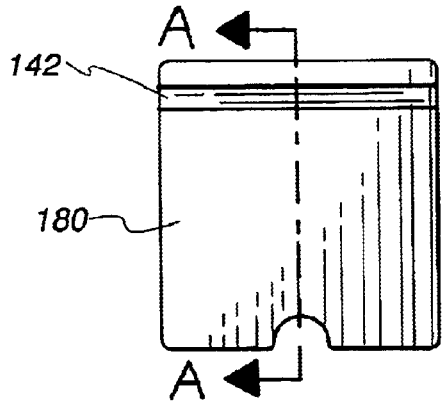
FIG. 10B is a rear elevational view of the support from FIG. 10A.
Figure 10C:
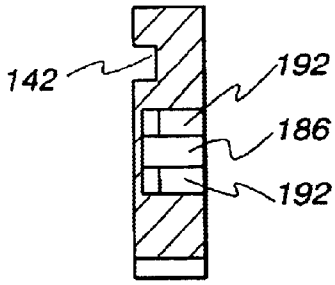
FIG. 10C is a cross-sectional view of the support from FIGS. 10A–B with the cross-section taken along lines A—A in FIG. 10B.
Figure 10D:
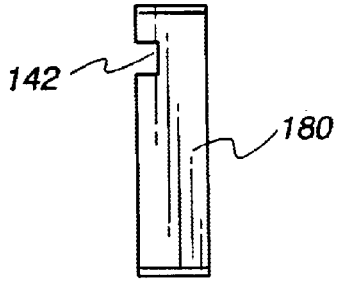
FIG. 10D is a side elevational view of the support from FIGS. 10A–C.
Figure 10E:
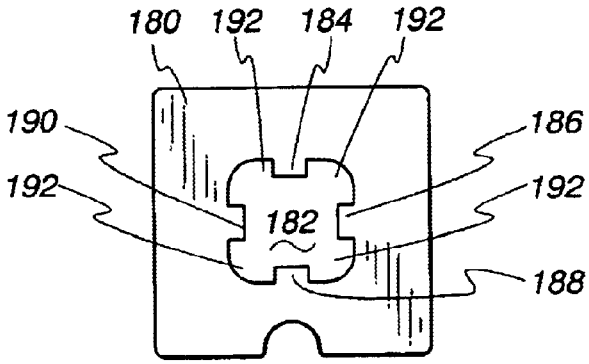
FIG. 10E is a rear elevational view of the support from FIGS. 10A–D.

Turning now to FIGS. 6–8, another embodiment of a low profile electronic component in accordance with the invention is shown generally at reference numeral 100. In this embodiment the component 100 comprises a transformer having a core comprising a generally cylindrical shaped insert 102 having first and second ends 104 and 106 with a main horizontal section 108 extending therebetween, and a sleeve 110 that is generally rectangular in shape and has first and second ends 112 and 114 with a main horizontal section 116 extending therebetween. A friction fit or press fit is used to retain the insert 102 in the sleeve 110. The sleeve 110 further contains at least one raised portion or shoulder 118 located about the main horizontal section 116. In the embodiment shown, one raised portion 118 appears which separates the sleeve 110 into a first or primary portion 120 and a second or secondary portion 122.

First and second supports 124 and 126 are connected to the sleeve 110 via respective receptacles 128 and 130. The receptacles 128 and 130 are similar in shape to that of the sleeve 110, which assists in positioning the supports 124 and 126 on the sleeve 110 and further assists in squaring the supports 124 and 126 of the component 100 on the sleeve 110. For example, in the embodiment shown, each end 112 and 114 of the sleeve 110 has four crescent-shaped projecting members 132 which mate with respective recesses located in the receptacles 128 and 130. These members 132 not only assists in positioning the supports 124 and 126 on the sleeve 110 but also ensure that the supports 124 and 126 are positioned squarely on the sleeve 110. Thus, the actual shape of the sleeve 110 and/or receptacles 128 and 130 serve to help orientate the supports 124 and 126 on the core. Furthermore, as mentioned above, the rectangular shape of the sleeve 110 shown in FIGS. 6–8 assists the component 100 in maintaining a low profile.

The receptacles 128 and 130 may also provide for at least a minimal amount of movement of the sleeve 110 and insert 102 with respect to the supports 124 and 126. For example, in a preferred embodiment a gap between the supports 124 and 126 and the sleeve 110 is provided to allow for flexing of the sleeve 110 and/or insert 102. Such a configuration increases the overall component's strength by allowing it to absorb forces encountered from dropping the component 100, (or a device containing the component), and encountered from various temperature changes. The presence of a gap also allows for variances in the tolerances of the core or variances in the size of the receptacles 128 and 130.

The supports 124 and 126 of the embodiment shown have two metalized pads each. The metalized pads 134, 136, 138 and 140, (or 134–140), are generally rectangular in shape and are used to electrically connect the component to corresponding lands on a PCB. Each support 124 and 126 has an arch separating the pads located thereon, which assists in preventing the metalized pads on each support from inadvertently being joined during the application of the metalized pads to the support. Although the pads 134–140 shown in FIGS. 6–8 are flat, alternate pads could be L-shaped (as shown in FIGS. 7 and 8) or U-shaped to further increase the strength of the connection between the supports 124 and 126 and the pads 134–140, and/or increase the strength of the connection between the component 100 and the PCB, as discussed above.

The supports 124 and 126 further include indexing channels 142 and 144 which help orient the part and provide a means for holding the supports 124 and 126 during the manufacture of the component 100. An alternate form of indexing channel will be discussed further below with respect to FIGS. 8A–E.

The electronic component 100 also includes first and second wires 146 and 148 which are wound around the main horizontal section 116 of the sleeve 110. More particularly, the first wire 146 is wound around the primary portion 120 of sleeve 110 and has its ends connected to the metalized pads 138 and 140 of support 126. The second wire 148 is wound around the secondary portion 122 of sleeve 110 and has its ends connected to the metalized pads 134 and 136 of support 124. With this configuration, the first wire 146 can be connected as the primary coil of the transformer and the second wire 148 can be connected as the secondary coil. The wires 146 and 148 do not need to be of the same size. For example, a lower gage wire may be used for the primary winding and a higher gage wire may be used for the secondary winding. Lower wire gages, however, will result in fewer turns of the wire being able to be made.

The raised portion or shoulder 118 serves as an insulator which separates the primary coil from the secondary coil and prevents arcing between the two coils. In alternate embodiments where a stronger or more powerful transformer is needed, the sleeve 110 may have additional raised portions 118 which are similarly used to separate coils and to prevent arcing. Furthermore, the sleeve 110 also serves as an insulator insulating the insert 102.

The ends of the wires 146 and 148 are preferably flattened in order to minimize the amount the metalized pads 134–140 are raised up from their corresponding lands located on the PCB. This helps ensure that the component is securely attached to the PCB once soldered and assists in maintaining the component's low profile. As with any transformer, the parameters of the component, (e.g., voltage, current, etc.), can be altered by increasing the number of turns of wires 146 and 148. For example, if the component 100 is setup as a step-up transformer and a higher voltage is desired, a higher gage wire can be used to produce more turns for the coil. Before applying the component to the desired application, however, the higher gauge wire must be evaluated to determine if it is capable of handling the current associated with the increased voltage. The ability to add more raised portions to the sleeve also helps in providing transformers with a variety of different parameters.

In a preferred embodiment, the wire 146 and 148 is made of a good conducting material such as copper, and the supports 124 and 126 are made of a mechanically strong material such as Alumina ceramic. With respect to the core, the insert 102 is made of a good magnetic material such as ferrite and the sleeve 110 is made of a material having a similar temperature coefficient as the PCB, such as plastic. A gap is provided between the receptacles 128 and 130 and the sleeve 110 in order to allow for the core to move with respect to the supports 124 and 126. This makes the component stronger and capable of absorbing some of the forces the component is exposed to. To further increase the strength of the component 100, the sleeve (within which the insert is disposed) is glued to the supports using a semi-rigid adhesive which further allows for movement of the core with respect to the supports, (e.g., allows the insert and/or sleeve to flex).

In order to address the need for low profile parts and the various height requirements associated therewith, the component 100 has been shortened (height wise) and widened (length wise). In doing so, one concern has been how the parts of the component 100 will react when operating at various temperatures. The purpose for having the temperature coefficient of the sleeve 110 match (or be similar to) the temperature coefficient of the PCB is to ensure that the component 100 will not fail during changes in temperature.

More specifically, by having similar temperature coefficients, the component 100 will expand/contract at the same, or a similar, rate as the PCB during temperature changes. If this was not the case, and the component did not expand/contract along with the PCB, the component 100 would likely break off of the PCB or cause one of the solder joints to break thereby making the component fail or work only intermittently. For example, if the sleeve 110 was made out of ceramic, the PCB would expand at a much faster rate than the ceramic and the component 100 (or at least one support 124 and 126) would break from the PCB. Alternatively, if the sleeve 110 was made out of plastic, which has a similar temperature coefficient to that of PCB, the component 100 will expand/contract along with the PCB without breaking.

The component 100 may also have a top portion 150 connected thereto for providing a flattened surface with which the component can be picked up using industry standard component placement equipment. Such a configuration would allow the component 100 to be packaged in tape and reel packaging which is preferred by purchasers of electronic components. In a preferred embodiment, the top portion 150 is generally rectangular in shape and connects to the upper surfaces of supports 124 and 126. The top portion 150 is preferably made of a magnetic material such as ferrite in order to enhance the magnetic characteristics and overall operation of the component 100. For example, a ferrite top portion will significantly increase the inductance of the component 100 and lower its leakage inductance. In alternate embodiments where such enhanced performance is not needed, the top portion 150 may be made from acrylic or like materials. Such a component can be used in applications such as inverter circuits for powering Cold Cathode Fluorescent Lights (CCFLs), Personal Digital Assistants (PDAs), telephone displays, etc. For example, this component can be used as a step up transformer capable of stepping up a 12V input to 600V for igniting the gases of a CCFL. As mentioned above, any number of different voltages can be achieved by simply adjusting the turns ration of the component.

FIGS. 9A–E depict various views of one of the supports 124 and 126 without their metalized pads 134–140. For purposes of clarity, the support in these drawing figures will be referred to as support 124. The support 124 is generally rectangular in shape and defines a generally rectangular receptacle 128. The receptacle 128 has an opening 160 that is tapered or beveled via shoulder 162. This configuration provides a lead-in which assists in inserting the sleeve 110 and core 102 into the support 124. The surface of the shoulder 162 is preferably angled at thirty degrees and assists in wicking the semi-rigid adhesive between the inner surfaces of the receptacle 128 and the outer surface of the first and second ends of the sleeve 112 and 114.

The support 124 has projecting members 164, 166, 168 and 170 (or 164–170) which define the mating crescent-shaped recesses 172 within which the projections 132 of the sleeve 110 are inserted. The support 124 can be positioned on the sleeve 110 in the proper manner through the cooperation of the recesses 172 and projections 132. For example, if the projecting members 132 of the sleeve 110 do not line up with the crescent-shaped recesses 172 of the support 110, the support 124 cannot be positioned on the sleeve 110. This is particularly helpful when an adhesive is being used to connect these parts of the component. The mating relationship between the projecting member 132 and the recesses 172 also helps ensure that the support 124 will be positioned squarely on the sleeve 110. Thus, the shape of the insert 102, sleeve 110 and receptacle 128 can help orient the support 124 on the component 100. Another aspect of the support shown in FIGS. 9A–E is that an arch is located in the lower surface of the support. The arch divides the lower portion of the support into two legs upon which the metalized pads 134 and 136 are connected. In a preferred embodiment, the surfaces of the support 124 are also rounded, including the surfaces where the arch meets the lower surface of the support.

Although the receptacles 128 and 130 discussed thus far with respect to component 100 have through openings passing through the entire support, alternate configurations may be used. For example, the component 100 could be configured so that the supports 124 and 126 are universal parts, such as the supports discussed with respect to component 10. Universal supports would allow the sleeve 110 to be inserted into the recesses 128 and 130 from either side of the supports 124 and 126.

Another form of support and receptacle that can be used with the electronic component is shown in FIGS. 10A–E. This support 180 has a receptacle 182 which does not pass through the entire body of the support, and does not have a beveled opening for assisting in the insertion of the sleeve 110 into the support 180. The recess 180 does, however, contain projecting members 184, 186, 188 and 190 which define crescent-shaped recesses 192 for guiding and/or mating with sleeve projections 132. This configuration assists in orienting the support 180 on the sleeve 110 squarely and in the right position. As with the parts of the electronic component discussed above, this support indicates the many variations that can be made with Applicants novel and non-obvious electronic component.

Another benefit to the components discusses herein is their ease of manufacture. It is estimated that an electronic component made in accordance with the invention can save anywhere between 50–75% of the costs for manufacturing like components currently available in the industry due, at least in part, to the labor savings that come from the ability to automatically wind the components 10 and 100.

Thus, in accordance with the present invention, an electronic component is provided that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A low profile surface mountable component having a strengthened structure comprising:

an elongated core having first and second ends;

first and second supports for supporting the core and for absorbing forces applied to the component that are attributable to mechanical shock, each of the supports defining a receptacle for receiving one of the core's first and second ends;

means between the ends of the core and the supports for permitting movement of the core with respect to the supports;

metalized pads provided on the supports for electrically connecting and mounting the supports to the printed circuit board; and a wire wound about at least a portion of the core and having ends electrically connected to the metalized pads of the supports.

2. A component according to claim 1, wherein the means for permitting movement of the core with respect to the supports comprises a gap between at least one end of the core and a portion of the receptacle within which the core end is inserted.

3. A component according to claim 1, wherein the means for permitting movement of the core with respect to the supports comprises a semirigid adhesive.

4. A component according to claim 1, wherein the wire is wound about a majority of the core and has a first end electrically connected to the metalized pad of one support and a second end electrically connected to the metalized pad of the other support.

5. A component according to claim 4, comprising a top portion connected to the supports for providing a flattened surface with which the component can be picked up using industry standard component placement equipment.

6. A component according to claim 5, wherein the top portion comprises a generally flat top surface with outer sidewalls extending downward therefrom for covering at least a portion of the wire wound core.

7. A component according to claim 4, wherein the core is generally rectangular in shape for assisting the component in maintaining a low profile and for assisting in orientating the supports on the core.

8. A component according to claim 4, wherein the receptacles have an opening through which an end of the core is inserted that is beveled for assisting in inserting an end of the core into the receptacle.

9. A component according to claim 4, wherein the receptacles of the supports are openings passing through a first and second side of the support so that the core may be inserted into the receptacle from either side of the support.

10. A component according to claim 1, wherein the core comprises:

a sleeve within which an insert is disposed, the sleeve having first and second ends with a main section extending therebetween; and at least one raised portion located about the main section of the sleeve for separating the sleeve into a first portion and a second portion.

11. A component according to claim 10, wherein the first and second ends of the sleeve are capable of being inserted into the receptacles of the supports and each support has at least two metalized pads, the wire of the component further comprising:

a first wire wound around the first portion of the sleeve and having first and second ends connected to metalized pads located on the first support; and a second wire wound around the second portion of the sleeve and having first and second ends connected to metalized pads located on the second support.

12. A component according to claim 10, wherein the sleeve comprises a plastic having a temperature coefficient that is similar to the temperature coefficient of the printed circuit board so that the component does not break when operating at temperature due to a thermal coefficient mismatch.

13. A component according to claim 10, comprising a top portion connected to the supports for providing a flattened surface with which the component can be picked up using industry standard component placement equipment.

14. A component according to claim 10, wherein the sleeve is shaped for assisting the component in maintaining a low profile and for assisting in orientating the supports on the core.

15. A component according to claim 10, wherein the receptacles have an opening through which an end of the sleeve is inserted that is beveled for assisting in inserting an end of the core into the receptacle.

16. A low profile surface mountable antenna for mounting on a printed circuit board having a strengthened structure for absorbing forces applied to the component that are attributable to mechanical shock, the component comprising:

a core made of magnetic material having first and second ends with a main section extending therebetween;

first and second supports for supporting the core and for absorbing forces applied to the component that are attributable to mechanical shock, each of the supports defining a receptacle for receiving one of the core's first and second ends and at least one receptacle receives a core end in such a way as to allow the core to move with respect to the support;

metalized pads located on the supports for electrically connecting and mounting the component to the printed circuit board; and a wire wound around the main section of the core and having a first end electrically connected to the metalized pad located on the first support and a second end electrically connected to the metalized pad located on the second support.

17. A low profile surface mountable antenna according to claim 16, wherein the at least one receptacle that allows the core to move has a gap between at least a portion of the core and a portion of the receptacle and the core is connected to the support via an adhesive in order to allow the core to move with respect to the support so that the component can absorb forces attributable to mechanical shock.

18. A low profile surface mountable transformer for mounting on a printed circuit board having a strengthened structure for absorbing forces applied to the component that are attributable to mechanical shock, the component comprising:

a core having a plastic sleeve within which an insert is disposed and having first and second ends with a main section extending therebetween, the main section of the sleeve having a raised portion which serves to separate the sleeve into a primary section and a secondary section;

first and second supports for supporting the sleeve and for absorbing forces applied to the component that are attributable to mechanical shock, each of the supports defining a receptacle for receiving one of the core's first and second ends and at least one of the receptacles receives a core end in such a way as to allow the core to move with respect to the support;

metalized pads located on the supports for electrically connecting and mounting the component to the printed circuit board;

a first wire wound around the primary section of the sleeve thereby making a primary coil and having first and second ends connected to the metalized pads of the first support; and a second wire wound around the secondary section of the sleeve thereby making a secondary coil and having first and second ends connected to the metalized pads of the second support.

19. A low profile surface mountable transformer according to claim 18, wherein the at least one receptacle that allows the core to move has a gap between at least a portion of the core and a portion of the receptacle and the core is connected to the support via an adhesive in order to allow the core to move with respect to the support so that the component can absorb forces attributable to mechanical shock.

* * * * *